United States Patent [19]

Kang

[11] Patent Number: 4,917,791

[45] Date of Patent: Apr. 17, 1990

[54] PROCESS AND CATALYSTS FOR HYDROCONVERSION OF COAL OR PETROLEUM ASPHALTENE TO DISTILLATE LIQUIDS

[76] Inventor: Chia-chen Chu Kang, 301 Gallup Rd., Princeton, N.J. 08540

[21] Appl. No.: 169,166

[22] Filed: Mar. 10, 1988

Related U.S. Application Data

[63] Continuation of Ser. No. 616,546, Jun. 1, 1984, abandoned, which is a continuation-in-part of Ser. No. 411,699, Aug. 24, 1982, abandoned.

[51] Int. Cl.[4] ..... C10G 45/04

[52] U.S. Cl. ..... 208/419; 208/216 PP; 208/415; 208/418; 208/420; 208/422

[58] Field of Search ..... 208/216 PP, 415, 418, 208/419, 420, 422

[56] References Cited

U.S. PATENT DOCUMENTS

| | | | |
|---|---|---|---|
| 2,120,715 | 6/1938 | Seguy | 208/59 |
| 3,530,066 | 9/1970 | Kuwata et al. | 208/216 PP |
| 3,635,814 | 1/1972 | Rieve et al. | 208/10 |
| 3,640,817 | 2/1972 | O'Hara | 208/216 PP |
| 3,723,296 | 3/1973 | Hohn | 208/59 X |
| 4,018,663 | 4/1977 | Kan, Jr. | 208/10 |
| 4,048,060 | 9/1977 | Riley | 208/216 PP |
| 4,294,685 | 10/1981 | Kim et al. | 208/10 |
| 4,297,242 | 10/1981 | Hensley et al. | 208/216 PP |
| 4,300,996 | 11/1981 | Kuehler | 208/10 |
| 4,395,328 | 7/1983 | Hensley et al. | 208/216 PP |
| 4,421,633 | 12/1983 | Shih et al. | 208/216 PP |
| 4,431,526 | 2/1984 | Simpson et al. | 208/216 PP |
| 4,454,026 | 6/1984 | Hensley et al. | 208/216 PP |
| 4,746,419 | 5/1988 | Peek et al. | 208/216 PP |
| 4,752,376 | 6/1988 | Pachano et al. | 208/216 PP |

*Primary Examiner*—Asok Pal

[57] ABSTRACT

A two-stage catalytic hydroconversion process using a large-pore catalyst in the first stage reactor and a small-pore catalyst in the second stage reactor in the two-stage process for hydroconversion of coal or petroleum asphaltene feed materials to produce distillate liquid fuels. The large-pore catalyst is characterized by having pore diameters larger than 1000Å occupying a major portion of the catalyst total pore volume of 0.2 to 1.0 cc/gm, and the small-pore catalyst is characterized by having pore diameters smaller than 1000Å occupying a major portion of the catalyst total pore volume.

22 Claims, 1 Drawing Sheet

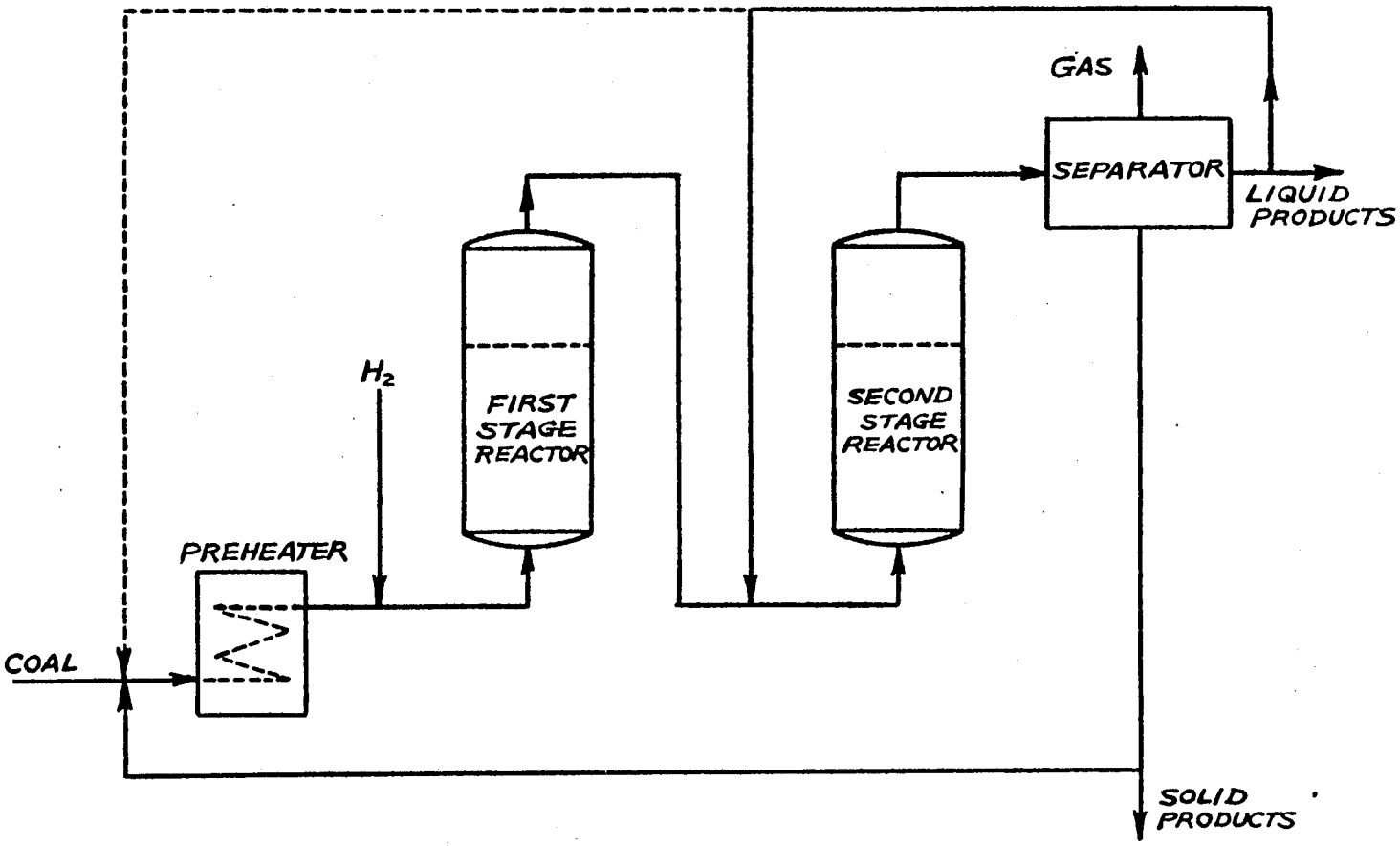
LIQUID PRODUCTS
SEPARATOR
GAS
SECOND STAGE REACTOR
FIRST STAGE REACTOR
$H_2$
PREHEATER
COAL
SOLID PRODUCTS

PROCESS AND CATALYSTS FOR HYDROCONVERSION OF COAL OR PETROLEUM ASPHALTENE TO DISTILLATE LIQUIDS

The United States government has patent rights therein for hydroconversion of coal.

This application is a continuation of application Ser. No. 616,546, filed June 1, 1984, which was a continuation-in-part of patent application Ser. No. 06/411,699, filed Aug. 24, 1982, now abandoned.

BACKGROUND OF INVENTION

This invention pertains to a catalytic two-stage hydroconversion process for coal or petroleum asphaltene feed materials to produce high yields of hydrocarbon distillate liquid products. It pertains particularly to such process which uses a large-pore catalyst in the first stage reactor and a small-pore catalyst in the second stage reactor, and to the catalysts used in the process.

The primary energy sources today or in the near future are coal and petroleum. In several regions of the United States, there are abundant supplies of various types of coal including bituminous, semibituminous and subbituminous, as well as lignite. To meet the ever increasing demand for transportation fuels, many methods have been disclosed in the prior art to convert coal into liquid fuels. Since the supply of petroleum is becoming depleted, the new upgrading technologies today are aimed at the conversion of petroleum asphaltene, which is the bottom of the barrel of crude oil, very heavy petroleum crudes or heavy hydrocarbon materials originated from tar sand or oil shale.

Coal and petroleum asphaltene are hydrocarbons having large molecular weights and very complicated molecular structures. For the production of distillate liquid fuels from coal, a step-wise series of reactions are envisioned: coal→preasphaltene (benzene-insoluble resid)→asphaltene (benzene-soluble hexane-insoluble resid)→distillate. For petroleum asphaltene processing, the reaction for producing distillate liquids proceeds likewise as follows: asphaltene (benzene-soluble hexane-insoluble)→oil (hexane-soluble)→distillate liquid.

Because of the ever increasing demand for transportation fuels relative to other energy needs, coal or petroleum asphaltene processing to yield a high percentage of distillate product is needed. Numerous methods have been disclosed in the art for these purposes. For coal processing, a single-stage catalytic process using an ebullating bed catalytic reactor is disclosed in U.S. Pat. No. 3,519,555; the catalyst is described as a hydrogenation catalyst selected from the group consisting of cobalt, molybdenum, nickel, iron and tin supported on a base selected from the group consisting of alumina, magnesia and silica. A multistage process for the production of hydrocarbons from coal employing a series of ebullating bed reactors is disclosed in U.S. Pat. No. 3,594,305. This process discloses that two or more of a first group of ebullating bed reactors effect removal of sulfur and oxygen and effect some hydrogenation, using as catalyst a supported sulfided Co-Mo, Ni-W, or Ni-Mo catalyst, with the temperature and pressure of reaction within the reactors being increased in each subsequent reactor as the product passes downstream, and a final group of reactors containing a noble metal catalyst at higher temperatures and pressures than in the first reactor series effect removal of nitrogen compounds and hydrogenate aromatic compounds.

The Solvent Refined Coal (SRC) Process, which recycles process hydrocarbon solvent to donate hydrogen for coal liquefaction, has high yield of unconverted coal plus resid. The Exxon Donor Solvent (EDS) Process is described by Ansell et al in the American Chemical Society, Division of Fuel Chemistry Preprints, Vol. 25, No. 3, 1980, p. 269. Using a hydrogenated recycle solvent, the process is still limited by low conversion of coal and resid. With vacuum bottoms material (1000° F.+) recycling, the coal liquefaction and conversion to 1000° F.− product is raised from 63 to 83 wt % of MAF Illinois No. 6 coal (Monterey mine) accompanied by an increase in hydrogen consumption from 4 to 6% wt. basis MAF coal. The high mineral-containing bottom fraction requires further processing for hydrogen production.

A two-stage coal liquefaction process called SRC I-LC Fining, is currently being developed. The first stage reaction is thermal, using recycle solvent from the catalytic second stage reaction to effect coal liquefaction. This two-stage process yields high percentage 1000° F.+ materials like the single-stage donor solvent processes. However, at the same distillate (1000° F.−) production level, the hydrogen consumption of this two-stage process is significantly lower than that of the EDS Process. The lower hydrogen consumption of this two-stage process is attributed to the lower operating temperature of the second stage reactor resulting in lower gas production.

The catalyst employed in coal liquefaction processes includes a variety of catalytically active materials on porous supports having large surface area. As stated in the background of U.S. Pat. No. 3,635,814 to Rieve et al, the desired pore size for a catalyst is about 50 to 250 Å with the most frequent pore size being 60 Å.

The pore structure of petroleum resid hydrodesulfurization catalyst is disclosed in a number of patents. U.S. Pat. No. 3,509,044 favors the exclusion of asphaltene by maximizing surface area contained in pores having diameters of 30–70 Å. U.S. Pat. No. 3,531,398 discloses an upper limit on the amount of macropore volume represented by pore diameters greater than 100 Å. U.S. Pat. No. 3,563,886 and U.K. Pat. No. 1,122,522 disclose regular pore size distribution of 0 to 240 Å with 85% of total pore volume in 50–200 Å range, and suggest that catalysts containing mostly micropores will be poisoned rapidly and asphaltene which penetrates the larger pores subsequently will block entrance to the smaller pores. NPA Pat. No. 6,815,284 discloses the desirability of intermediate pores (100 to 1000 Å) plus channels (>1000 Å) to take up preferentially absorbed large molecules without causing blockage, so that the smaller size pores can desulfurize smaller molecules. German Pat. No. 1,770,996 specifies 0.3 cc/mg of pore volume in diameters larger than 75A and many pores from 1000 to 50,000A, and prefers the open structure for collection of coke and metals.

Commercial catalyst, such as American Cyanamid HDS 1442A, is an effective coal liquefaction catalyst or a petroleum asphaltene hydrodesulfurization and hydroconversion catalyst for a single-stage process. Such single-stage processes are known respectively as H-Coal process and H-Oil process developed by Hydrocarbon Research, Inc. This HDS 1442A catalyst is a special Co-Mo catalyst characterized by its bimodal pore size distribution, with the micropore diameter peaking around 50A and occupying about ⅔ of its total pore volume of 0.7 cc/gm, and the macropore diameter peaking around 2000 Å and occupying about ⅓ of the total pore volume. This catalyst has to serve many fucntions. For example, for coal conversion, the catalyst breaks down the large coal molecules to preasphaltene, and converts preasphaltene to asphaltene, then to distillate liquids and desulfurizes these fractions.

A number of significant advantages are obtained by use of a bimodal catalyst with a suitable surface area of 100 to 250 $m^2/g$, as disclosed in U.S. Pat. No. 4,294,685. The catalyst support may be formed of gamma alumina with small pores. The preferred alumina support disclosed in U.S. Pat. No. 3,635,814 is eta alumina. The large pores can be formed by known techniques, such as grinding the alumina to a fine powder and then binding the particles together to form extrudates. During that process, the large pores are generated. This technique for forming large pores is described in U.S. Pat. No. 3,530,066. As disclosed in the art, other pore growth promoting conditions may be used, such as heating the alumina support material in the presence of a gas or a metal compound, steaming at elevated temperatures, etc. In another method, the large pores may be introduced during preparation of the base material by the use of strong mineral or organic acids. Another method involves the addition of a boric acid-phosphoric acid solution to the alumina gel. Still another method is to introduce a relatively large amount of removable materials which may be volatile or decomposable into gases by the application of heat. For example, ammonium carbonate, volatile aromatics, etc., have been employed as removable materials.

Significant process advantages are obtained by using a catalyst with bimodal pore size distribution for coal conversion or for petroleum asphaltene hydrodesulfurization and conversion. For example, such bimodal catalysts are more active and/or deactivate slower. However, the bimodal catalyst still has problems. For coal conversion, high temperature and high hydrogen pressure are needed for achieving high coal conversion, and the preasphaltene conversion capability of this catalyst falls rapidly in the beginning of operations. Analysis of spent catalyst shows that the micropores are filled with carbon deposition within a few days operations, but the macropores contain very little carbon deposition. This indicates that carbon deposition causes pore mouth plugging, thereby resulting in rapid catalyst deactivation, and that catalysts containing micropores smaller than about 50A should be avoided. Metal deposition, such as titanium, causes a further gradual deactivation of the catalyst. For petroleum hydrodesulfurization and asphaltene conversion, carbon deposition and nickel and vanadium deposition cause rapid catalyst deactivation.

Furthermore, a single-stage catalytic hydrocarbon conversion process using a catalyst with bimodal pore size distribution has a main drawback that all the conversions are effected at one reaction temperature, which is the high temperature of about 850° F. needed for rapid conversion of coal or petroleum asphaltene. This high reaction temperature produces undesired high gas yield and high carbon deposition on the catalyst. High gas yield results in a less desirable product distribution and high hydrogen consumption. High carbon deposition on the catalyst causes rapid catalyst deactivation. Thus, there is a need to improve the single-stage catalytic process for hydroconversion of coal and petroleum asphaltene.

SUMMARY OF INVENTION

It is, therefore, an object of the present invention to provide a new and improved, catalytic two-stage hydroconversion process for the production of high yields of low-boiling hydrocarbon liquid products from coal or petroleum asphaltene feed materials, which process utilizes large pore size catalyst in the first stage reactor to effect high coal and preasphaltene conversion or high petroleum asphaltene conversion, and utilizes a small pore size catalyst in the second stage reactor to effect high coal asphaltene conversion or high petroleum oil conversion.

Another object of this invention is to reduce the yield of solid products (unconverted coal, minerals, etc.) resulting from coal conversion to materials having very low fuel value, so that gasification of such solid carbonaceous products for hydrogen production is not required. Thus, coupling of the emergent coal liquefaction technology with gasification technology is avoided, which provides a reduction in risk for overall project success and improves the operability of a commercial facility. In addition, the elimination of the solid product gasification step lowers the facility total capital cost.

Another object of this invention is to provide a two-stage hydroconversion process capable of more efficient utilization of hydrogen than for current single-stage coal liquefaction or petroleum asphaltene conversion processes.

Still another object is to provide improved inexpensive, large pore, low surface area catalysts containing low amounts of active metals.

A further object of this invention is to provide a two-stage hydroconversion process needing a relatively small preheater.

Various other objects and advantages of this invention will become apparent from the accompanying description and disclosure.

This invention provides a catalytic two-stage process for the hydrogenation and hydroconversion of coal and preasphaltene or petroleum asphaltene using a large-pore size catalyst in the first stage reactor and a small-pore size catalyst in the second stage reactor. The first-stage reactor is usually operated at higher reaction temperature than the second-stage reactor. The main function of the large-pore catalyst in the first stage reactor is to convert coal and coal preasphaltene to coal asphaltene, or to convert petroleum asphaltene to oils, which are further converted to distillate liquids in the second stage reactor using a small-pore size catalyst. The first stage and second stage reactors are preferably ebullated bed reactors.

The coal hydrogenation process using an ebullated catalyst bed reactor is described by U.S. Pat. No. 3,519,555. By concurrently flowing streams of coal-oil slurry and hydrogen upwardly through a vessel containing a mass of solid particles of a catalyst, and expanding the mass of solid particles at least 10% over the volume of the stationary mass, the solid particles are placed in random motion by the upflowing streams. The characteristics of the ebullated mass of solid particles at a prescribed degree of volume expansion can be such that a finer, lighter solid such as coal particles and coal minerals will pass upwardly through the mass, so that the ebullated catalyst particles are retained in the reactor and the finer lighter material may pass from the reactor. To attain the desired degree of volume expansion of the catalyst particles, a recycle liquid stream may be removed above the upper level of ebullation and recycled internally to the bottom of the reactor. The ebullated bed reactor is especially suitable as the first-stage reactor in that it permits the admission of a feed mixture at temperatures much below the reactor outlet temperature. The relatively cold feed mixture will be brought quickly to the incipient reaction temperature by internally recycling the hot liquid from above the upper level of ebullation.

For coal liquefaction processes, the feedstream preheater has dual functions. Besides providing the sensible heat to bring the coal slurry feed to near reactor temperature, the preheater provides heat needed for effecting the endothermic coal dissolution which starts at about 550° F. and finishes at about 700° F. The donor solvent speeds up coal dissolution, and affects the exothermic coal hydrogenation reaction to a certain extent. The presence of a hydrogenation catalyst in the reactor promotes the conversion of dissolved coal and preasphaltene and generates heat from the conversion to bring the reactants quickly up to effective reaction temperature, hence the portion of the reactor which serves as a coal dissolver will be small. Since the preheater costs much more than the reactor per unit volume, the presence of a catalyst in the first-stage ebullated bed reactor permits the installation of a relatively small preheater thereby resulting in lower capital cost.

For coal processing, the large-pore catalyst used in the first stage reactor contains macropores having median pore diameters larger than about 1000 Å occupying a major part of the total pore volume of the catalyst of 0.2–1.0 cc/gm and avoiding micropores having diameters smaller than about 50A. For processing bituminous coal, the preferred range of pore diameters is 2000 to 9000 Å. The large-pore catalysts having a median pore diameter of 2350, 4000, or 8400A, total pore volume of 0.7 cc/g, and active metal contents of 1.5 wt % of (Mo+Co or Mo+Ni) in a ratio of five $MoO_3$ to one CoO or to one NiO convert more coal than known HDS 1442A catalyst, which has macropore diameters peaking at 2000 Å occupying only ⅓ of total pore volume and micropore diameters peaking at 50 Å occupying ⅔ of total pore volume, a total pore volume of 0.7 cc/g, and active metal contents of 15% $MoO_3$ and 3% CoO. The large-pore catalysts of this invention are as resistant to coking as HDS 1442A. Coking occurs during hydrogen-donor solvent processing of coal when the amount of donor solvent present in the reactor is insufficient to prevent the recombination of the free radicals to form coke, which is insoluble in pyridine. The catalyst is capable to promote hydrogen transfer from the catalyst surface to terminate the free radicals. Larger pore catalysts having median pore diameter of 18,500 Å, total pore volume of 0.7 cc/g, and active metal contents of 1.5% Mo+Co, or Mo+Ni converts less coal than HDS 1442A, but converts more coal than donor solvent processing. However, the hydrogen consumption for this larger pore catalyst is significantly lower than for the three other large-pore catalysts. Use of the larger pore catalyst might be adequate under certain processing conditions for certain preferred product distribution. Since subbituminous coal has larger molecular sizes than bituminous coal, for processing subbituminous coal the preferred range of pore diameter is larger than the 2000 to 9000 Å range preferred for processing bituminous coal.

The molecular sizes of the first-stage reactor effluent (feed to second stage) vary with the rank of coal feed or the origin of the petroleum asphaltene, the severity of the processing conditions of the first stage reactor, and are affected by the pore sizes of the catalyst in the first stage. Thus, the preferred pore size range of the second-stage reactor catalyst is best defined as relative to the pore sizes of the first-stage catalyst. The preferred pore diameter range of the small-pore catalyst used in the second stage reactor is 1/5 to 1/20 of the preferred diameter range of pores in the first-stage catalyst. The catalyst in the second stage reactor preferably has pore diameters of 75–1000 Å.

For coal processing, the preferred range of pore diameter of the first-stage catalyst is 2000 to 20,000 Å and occupying a major portion of the total pore volume. For petroleum asphaltene processing, the preferred range of pore diameter of the first-stage catalyst is 1000 to 3000 Å occupying a major portion of the total pore volume.

The active metals for these catalyst comprise, but are not limited to Co, Mo, Ni, W, Sn and mixtures thereof. The remaining material of these catalysts is comprised of a refractory support containing one or more of the oxides of aluminum, silicon, calcium, magnesium, or titanium or compounds thereof. The preferred refractory supports are aluminum oxide, silicon oxide, or a mixture of aluminum oxide and silicon oxide.

BRIEF DESCRIPTION OF DRAWING

In order to further describe the process of the invention, reference is now made to the drawing. Coal processing is used as an example to describe the present invention.

A coal such as bituminous, subbituminous or lignite is ground and the coal particles mixed with appropriate amounts of the two recycle streams: hydrocarbon solvent and solids-containing liquid to form a slurry. The coal slurry enters a preheater and exits at a temperature between 500°–650° F. Such heated coal slurry feedstream is mixed with recycle hydrogen as well as make-up hydrogen as needed.

The entire mixture of coal-oil slurry and hydrogen then enters one or more first stage ebullated bed catalytic reactors passing upwardly from the bottom at a rate and under pressure and at a temperature to accomplish the desired hydrogenation. The catalyst is preferably in the form of cylinders, beads or like materials approximately in the size range of 1/32 to ¼ inch. The size and shape of the catalyst used will depend on the particular processing conditions, e.g. the viscosity, density and velocity of the liquid in the reactor. A recycle liquid stream, which may be internal or external of the reactor, may be removed above the upper level of ebullation and recycled to the bottom of the reactor to maintain an ebullated catalyst bed. The catalyst in the first stage reactor contains large pores with macrophore diameters not smaller than 1000 Å occupying a major portion of its total pore volume, and avoids micropores having pore diameters smaller than 50A. The preferred range of diameter of these macropores is 2000 to 20,000 Å. The catalyst may contain Co-Mo or Ni-Mo on an alumina support. The preferred total pore volume of the catalyst is 0.2 to 1 cc/g. Preferred operating conditions are in the range of 700° to 900° F. temperature and 2000–3000 psig total pressure. Coal throughput is at the rate of 5 to 150 pounds per hour per cubic foot of reactor space to achieve high hydroconversion to liquids, so that the resulting solid products have very little fuel value. The petroleum asphaltene feed rate is between 0.1 to 2.0 liquid hourly space velocity (LHSV).

The process stream leaving the first-stage reactor enters one or more second stage reactors at a temperature usually lower than the operating temperature of the first stage and under slightly lower pressure. The catalyst in the second stage reactor contains pores much smaller than pores of the first-stage catalyst. The preferred pore diameter range of the second-stage catalyst is 1/5 to 1/20 of the preferred range of pore diameter of the first-stage catalyst. Preferred second stage reactor operating conditions are in the range of 650° to 850° F. temperature and 2000–3000 psig total pressure. Feed throughput is at the rate to yield increased hydrocarbon liquid product and a solid product having very little fuel value.

The second stage effluent is separated by a series of conventional separators, the gases being separated from the liquid fraction by a series of high and low pressure flash stages. The mineral, unconverted coal and heavy hydrocarbon materials are separated from the liquid product by vacuum distillation or other suitable means. A portion of the liquid product will be recycled and used to prepare the initial coal slurry feed. A portion of the solid-containing products may also be recycled through the first stage or the second stage reactors.

The following examples are offered to further illustrate the present invention.

EXAMPLE 1

Comparative experiments are conducted employing a laboratory test designed to demonstrate the high coal conversion capability of the large pore catalyst (first-stage catalyst) of the present invention.

A series of catalysts are prepared by impregnating four large-pore alumina supports with appropriate salt solutions. These supports are in the form of 1/16×3/16" extrudates, and having median pore diameter varying from 2350 to 18,500A and surface area from 7 to 3 $m^2/g$. The capability of the support to absorb water is determined. Appropriate concentrations of salt solutions are prepared from $(NH_4)_6Mo_7O_{24}.4H_2O$ and $Ni(NO_3)_2\ 6H_2O$ or $Co(NO_3)_2.6H_2O$ for the preparation of catalyst containing 1.5 wt % of Mo+Ni or Co in a ratio of 5 to 1 $MoO_3$ to NiO or CoO. A content of 0.75 wt % Mo+Ni or Mo+Co is sufficient to give a monolayer coverage of the support with an average pore diameter of 2000A and a pore volume of 0.7 cc/g. These solutions are mixed at room temperature to produce a quantity sufficient for 100% excess of the amount abosrbed by 100 g of the support. The support is added to the solution immediately and the contents are gently swirled for 5 minutes. For example, for a support absorbing 0.7 g $H_2O/g$, 2.23 g $(NH_4)_6Mo_7O_{24}.4H_2O$ is dissolved in 70 g water and 1.42 g $Ni(NO_3)_2.6H_2O$ or $Co(NO_3)_2.6H_2O$ in 70 g water. The two solutions are mixed and 100 g support is added to this solution. The excess solution is drained off. The excess solution on the catalyst extrudates is removed by spreading them onto a paper towel and rolling gently for a few times. The weight increase of the support is determined. The contents of (Mo+Ni or Co) in the catalyst is calculated from this weight increase.

The catalyst extrudates are placed in an oven at room temperature; the temperature of the oven is raised to 250° F. in about 30 minutes, and the catalyst is dried for 2 hours at 250° F. The extrudates are gently stirred and rolled around about every 10 minutes during the period of the preheating and the first half hour of drying at 250° F. Finally the extrudates are calcined at 930° F. for 2 hours. During calcination, the catalyst is mixed by transferring it into another dish every half hour.

The catalyst is pulverized and screened to yield a 20− to 40− mesh fraction, which is calcined at 900° F. for 2 hours and cooled in a desiccator over $P_2O_5$. The calcined catalyst is presulfided with 10% $H_2S$ in $H_2$ in $H_2$ prior to charging to a reactor. A factor is calculated for converting the weight to dry catalyst prior to presulfiding. Three Co-Mo catalysts and two Ni-Mo catalysts are prepared. Pore size distribution of these five catalysts and HDS 1442A are measured by mercury porosimetry at 130° contact angle. The pertinent characteristics of these catalysts are shown in Table 1 below.

TABLE 1

PORE CHARACTERISTICS OF LARGE-PORE CATALYST

| Catalyst | Median Pore Dia., Å | Total Pore Vol., cc/g | >2,000Å Pore Vol., cc/g | 2,000–9,000Å Pore Vol., cc/g | Surface Area $m^2/g$ | Packing Density lbs/cu ft |
|---|---|---|---|---|---|---|
| HDS 1442A | 120* | 0.69 | 0.13 | 0.11 | 332 | — |
| CT 5227 Co—Mo | 2,350 | 0.69 | 0.49 | 0.44 | 5.5 | 38.9 |
| CT 4247 Co—Mo | 4,000 | 0.69 | 0.61 | 0.50 | 6.9 | 35.4 |
| CT 4247 Ni—Mo | 4,000 | 0.69 | 0.61 | 0.50 | 6.9 | 35.4 |
| CT 6227 Co—Mo | 8,400 | 0.72 | 0.71 | 0.34 | 3.8 | 38.0 |
| CT 10267 Ni—Mo | 18,500 | 0.71 | 0.71 | 0.21 | 2.9 | — |

*Average pore diameter calculated from pore volume of 0.69 cc/g and surface area of 332 $m^2/g$.

The characteristics of the Co-Mo catalyst and Ni-Mo catalyst prepared from the same alumina support are the same.

Catalyst activity experiments are carried out in a 1-liter autoclave reactor unit. A 300-cc hydrogen reservoir is included in the unit to feed the hydrogen needed to maintain a constant operating pressure in the reactor. A relative hydrogen consumption value of each experiment can be calculated from the pressure drop in the reservoir, which is registered by a precision gauge. The feedstocks are a mixture of Kentucky coal and a recycle hydrocarbon solvent produced from the Solvent Refined Coal (SRC) processing of this coal. Analyses of the coal feed and reaction solvent used are shown in Tables 2 and 3.

TABLE 2

| ANALYSIS OF KENTUCKY COAL FEED | |
|---|---|
| Sieve Analysis: | |
| +100 mesh | 0.35% |
| 100–200 mesh | 4.74% |
| −200 mesh | 94.89% |
| Proximate Analysis: | |
| Moisture | 1.33% |
| Ash | 9.24% |
| Volatile Matter | 34.20% |
| Fixed Carbon | 55.23% |
| Ultimate Analysis: | |
| Carbon | 72.57% |
| Hydrogen | 5.23% |
| Nitrogen | 1.54% |
| Sulfur | 2.81% |
| Chlorine | 0.29% |
| Ash | 9.36% |
| Oxygen, by difference | 8.20% |
| Pyridine-Insoluble | 70.5% |

TABLE 3

| ANALYSIS OF REACTION SOLVENT | |
|---|---|
| Elemental Analysis | |
| Carbon | 85.98% |
| Hydrogen | 8.51% |
| Nitrogen | 0.66% |
| Sulfur | 0.39% |
| Chlorine | 0.15% |
| Ash | 0.11% |
| Oxygen, by difference | 4.20% |
| ASTM Distillation | |
| Vol. % off | Vapor Temperature, °F. |
| IBP | 438 |
| 10 | 484 |
| 20 | 503 |
| 30 | 515 |
| 40 | 531 |
| 50 | 555 |
| 60 | 587 |
| 70 | 621 |
| 80 | 667 |
| 90 | 728 |
| 95 | 781 |
| 96 (end point) | 806 |
| Residue | 2% |
| Loss | 2% |
| Experiments are carried out under conditions listed below. | |
| Coal charge, g | 50 |
| SRC recycle solvent, g | 100 |
| Catalyst, 20–40 mesh, presulfided, g | 7.5 |
| Temperature, °F. | 830, 850 |
| Reaction time, min | 30 |
| Pressure, psig | 2500 |
| Stirring rate, rpm | 1000 |

The reaction product is analyzed as follows. The autoclave contents are transferred into a beaker and weighed, then filtered under vacuum on a 3-in Buchner funnel using Whatman #30 filter paper (medium porosity). The autoclave is rinsed 3 times with 15 cc tetrahydrofuran each time, and the rinsings are combined and used to wash the filter. Finally the filter cake is washed with 50 cc fresh tetrahydrofuran. The filter cake together with the funnel is transferred into a beaker and dried at 250° F. to constant weight.

The entire amount of filter cake, consisting of catalyst and coal residue together with the filter paper, is transferred to a thimble and extracted with 240 cc tetrahydrofuran (THF) in a Soxhlet extractor. The extraction is carried out over a period of 17 hours. After extraction, the thimble containing filter paper, catalyst, and coal residue is dried at 250° F. to constant weight. The weight of THF-insoluble residue (including catalyst) is calculated by substracting the weight of filter paper and thimble from the total weight. The thimble containing the tetrahydrofuran-insoluble coal residue, catalyst and filter paper is put back in the Soxhlet extractor and extracted with 240 cc pyridine for 17 hours. After pyridine extraction, the thimble and its contents are dried at 280° F. overnight to constant weight. The weight of pyridine-insoluble residue (including catalyst) is calculated. The thimble and its contents are ashed in a muffle furnace, following ASTM D 3174-73 procedure, "Ash in the Analysis of Coal and Coke". The extraction residue is ashed in a muffle furnace at 1290° to 1380° F. for 4 hours, cooled and weighed. This is followed by another ashing step at 1380° F. for 2 hours to assure the completeness of ashing. The loss of catalyst weight under this second ashing condition is insignificant.

The percentages of THF-insoluble and pyridine-insoluble yields of dry coal are calculated from the weights of THF-insoluble or pyridine-insoluble residue and the weight of ash.

The filtrates and washings combined with the THF extract are charged to a distillation flask and the tetrahydrofuran is distilled off. The THF-soluble liquid product is distilled under vacuum, following ASTM D 1160-77 procedure, to 975° F. (atmospheric pressure). The 975° F.+ fraction is weighed and ground. Three g of 975° F.+ is extracted with 100 cc of toluene in a Soxhlet extractor for 17 hours. The residue is dried to constant weight at 250° F. and ashed in a muffle furnace. Usually an insignificant amount of ash, if any, is obtained. The percentages of 975° F.+ and toluene-insoluble 975° F.+ materials are calculated. Toluene-soluble of 975° F.+ material is obtained by difference.

Similar catalyst activity experiments are conducted using five large pore catalysts. Among these five, three catalysts contain 1.5% (Mo+Co) and two contain 1.5% (Mo+Ni). Two types of baseline experiments are carried out: (1) thermal reaction without any catalyst, and (2) reaction with a sample of HDS 1442A catalyst obtained from Hydrocarbon Research, Inc., which is a commercial catalyst used in the H-Coal Process. Experiments are carried out at two temperature levels, 830° F. and 850° F. The autoclave unit is a static system operated at constant pressure of 2500 psig. More gas product is produced at 850° F. than at 830° F. so the hydrogen partial pressure in the autoclave is higher at 830° F. than at 850° F. Hence the 850° F. operation favors coke formation in comparison to the 830° F. operation. Catalyst evaluation at two temperature levels provides information about the coking resistant capability of the catalyst.

Table 4 shows the resulting distribution of 975° F.+ materials: unconverted coal plus coke (THF-insoluble or pyridine-insoluble), preasphaltene (toluene-insoluble), and the sum of these two.

A small but consistent difference exists between THF-insoluble and pyridine-insoluble materials.

TABLE 4

HEAVY PRODUCT YIELDS (975° F.+) WT % OF COAL FEED

| Catalyst | Preasphaltene (Toluene-Insoluble) | | Unconverted Coal + Coke: Tetrahydrofuran Insoluble | | Unconverted Coal + Coke: Pyridine Insoluble | | Toluene-Insoluble + Tetrahydrofuran Insoluble | |
|---|---|---|---|---|---|---|---|---|
| Designation | 830° F. | 850° F. | 830° F. | 850° F. | 830° F. | 850° F. | 830° F. | 850° F. |
| Thermal | 37.4 | 32.1 | 12.5 | 17.1 | 11.8 | 16.6 | 49.9 | 49.2 |
| HDS 1442A | 28.8 | 28.2 | 11.9 | 12.6 | 11.8 | 12.3 | 40.7 | 40.8 |
| CT 5227 Co—Mo | 40.8 | 35.5 | 5.5 | 6.8 | 4.9 | 6.5 | 46.3 | 42.3 |
| CT 4247 Ni—Mo | 36.2 | 36.9 | 7.8 | 8.1 | 7.4 | 7.6 | 44.0 | 45.0 |
| CT 4247 Co—Mo | 38.2, 34.6 | 32.0 | 6.4, 6.9 | 8.3 | 6.3, 6.5 | 7.9 | 44.6, 41.5 | 40.3 |
| CT 6227 Co—Mo | 38.8 | 34.0 | 6.7 | 7.8 | 6.3 | 7.2 | 45.5 | 41.8 |
| CT 10267 Ni—Mo | 39.3 | 36.9 | 8.7 | 12.7 | 8.6 | 12.0 | 48.0 | 49.6 |

The pyridine-insoluble yields are about 0.5% lower than the THF-insoluble yields. The large pore catalysts produce much higher coal conversion than the HDS 1442A catalyst which converts more coal than the thermal operation.

Comparing the data between 830° and the 850° F. reaction temperatures, an increase in unconverted coal yield from 12.5% to 17.1% for the thermal experiments indicates that more coking occurs at 850° F. Four large pore catalysts are at least as resistant to coking as HDS 1442A catalyst, as shown by their ability to maintain the unconverted coal yields under 850° F. reaction temperature at substantially the same level as those at 830° F. One large pore catalyst, CT 10267 Ni-Mo, which has much larger pores than the other four, does not prevent coking at 850° F.

HDS 1442A catalyst has lower preasphaltene yields than the large pore catalysts. The sum of unconverted coal and preaasphaltene yields are the highest for the thermal and the larger pore catalyst at 49% of coal feed, and lowest for HDS 1442A catalyst at 41% of coal feed. The large pore catalysts yield an average of 43.5% unconverted coal and preasphaltene which is in the middle of the range.

The pressure drop in the hydrogen reservoir is recorded during each experiment and used as a measure of relative hydrogen consumption. These pressure drop data represent a set of relative values between catalytic and thermal experiments at a certain temperature. These relative hydrogen consumption values fall into 4 groups as shown in Table 5.

TABLE 5

RELATIVE HYDROGEN CONSUMPTION VALUES

| Catalyst | g $H_2$/100 g Coal, calculated from pressure drop in hydrogen reservoir | |
|---|---|---|
| Designation | At 830° F. | At 850° F. |
| Thermal | 0.4 | 0.05 |
| HDS 1442A | 1.5 | 1.3-1.7 |
| Large Pore Catalysts | 0.7-1.5 | 0.8-1.1 |
| Larger Pore Catalyst | 0.54 | 0.57 |

The relative hydrogen consumption values utilizing the catalysts are in the following order: HDS 1442A>-large pore catalysts>larger pore catalyst>thermal, whereas the unconverted coal+coke yields fall into the following order: thermal>HDS 1442A≃larger pore catalyst>larger pore catalysts. These data indicate that, using a large pore catalyst, hydrogen is selectively consumed towards coal conversion.

EXAMPLE 2

These experiments are carried out to demonstrate the excellent quality of the large pore catalyst of the invention in achieving a low deactivation rate. Catalyst aging tests are conducted employing a continuous coal liquefaction unit to establish catalyst aging behavior in an 160-hour test. The continuous unit consists of sections for coal slurry feed, hydrogen feed, 1-liter stirred autoclave reactor, and liquid product collectors. The autoclave reactor contains an annular catalyst basket placed in a fixed position and an impeller. The catalyst basket and impeller are designed to give adequate mixing and contacting of the reaction mixture with the catalyst.

The standard test conditions are:

| | |
|---|---|
| Catalyst | 60 cc, 1/16" extrudate |
| Coal slurry | 25% Illinois No. 6 coal in SRC solvent |
| Temperature | 825° F. |
| Pressure | 2000 psig |
| Reactor holdup | 315 cc |
| $H_2$ feed rate | 225 1/hr (8 SCFH) |
| Slurry feed rate | 410 g/hr |
| Residence time | 47 min. |
| LHSV | 1.7 g coal/hr/cc catalyst |
| Mixing speed | 1500 rpm |

Comparative experiments are conducted with catalysts under the standard conditions. These experiments are: thermal, HDS 1442A, and CT 4247 Co-Mo catalysts. A thermal experiment yields 14% unconverted coal and 29% preasphaltene basis MAF coal. Catalyst aging data are shown in Table 6.

TABLE 6

CATALYST AGING DATA

| Time on Stream Hour | Catalyst Age lb. Coal per lb. Catalyst | Heavy Product Yields, Wt % of MAF Coal: Unconverted Coal (THf-Insoluble) | | Preasphaltene (Benzene-Insoluble) | | Unconverted Coal + Preasphaltene | |
|---|---|---|---|---|---|---|---|
| | | HDS1442A | CT4247 Co—Mo | HDS1442A | CT4247 Co—Mo | HDS1442A | CT4247 Co—Mo |
| 21 | 56 | 12 | 8 | 10 | 26 | 22 | 34 |
| 43 | 115 | 12 | 8 | 13 | 27 | 25 | 35 |
| 67 | 179 | 11 | 9 | 17 | 25 | 28 | 34 |
| 90 | 240 | 13 | 9 | 19 | 26 | 32 | 35 |
| 116 | 310 | 13 | 10 | 20 | 28 | 33 | 38 |
| 139 | 371 | 14 | 9 | 20 | 28 | 34 | 37 |

TABLE 6-continued

| Time on Stream Hour | Catalyst Age lb. Coal per lb. Catalyst | CATALYST AGING DATA Heavy Product Yields, Wt % of MAF Coal: Unconverted Coal (THf-Insoluble) HDS1442A | Unconverted Coal (THf-Insoluble) CT4247 Co—Mo | Preasphaltene (Benzene-Insoluble) HDS1442A | Preasphaltene (Benzene-Insoluble) CT4247 Co—Mo | Unconverted Coal + Preasphaltene HDS1442A | Unconverted Coal + Preasphaltene CT4247 Co—Mo |
|---|---|---|---|---|---|---|---|
| 163 | 435 | 13 | 10 | 24 | 27 | 37 | 37 |

CT 4247 Co-Mo shows consistently lower unconverted coal yields than HDS 1442A catalyst. For preasphaltene conversion, HDS 1442A has high initial activity, but its activity decreases rapidly. CT 4247 shows low initial activity, but hardly any deactivation. At the end of 163 hours and catalyst age of 435 lb. coal/lb. catalyst, HDS 1442A approaches CT 4247 Co-Mo's performance in preasphaltene conversion. The catalyst deactivation data indicate that, having very low catalyst deactivation rate, the replacement rate of CT 4247 Co-Mo catalyst should be lower than that of HDS 1442A to attain the same level of preasphaltene conversion.

Analyses of used catalysts show that used CT 4247 Co-Mo contains only 1.9% carbon and used HDS 1442A contains 15% carbon. Since CT 4247 Co-Mo and HDS 1442A have the same pore volume, 0.7 cc/g, CT 4247 Co-Mo will have more pore volume available to accommodate metal deposition than will HDS 1442A catalyst.

EXAMPLE 3

This series of experiments are conducted to demonstrate (1) the excellent capability of the small pore catalyst to effect coal asphaltene conversion in the second stage reaction, and (2) the high asphaltene conversion achieved at reaction temperature lower than that of the first stage reactor.

Experiments are carried out in an up-flow fixed bed reactor. Heat is supplied to the reactor by means of an electrically heated lead bath designed to maintain isothermal operation. The reactor has an inside diameter of ½ inch; the catalyst bed is 13 inches long and occupies a volume of 150 cc. The feed material mixed with hydrogen is fed to the reactor. The mixed vapor and liquid product from the reactor is cooled and passed to a high pressure receiver. The liquid is let down in pressure and passed to a low pressure receiver. The gas stream is vented, and the liquid product is collected and weighed periodically.

The feedstock is a mixture of 40% SRC product and 60% SRC solvent from SRC processing of Illinois No. 6 coal (Monterey. Analyses of the feedstock is shown in Table 7.

TABLE 7

| ANALYSES OF SRC FEEDSTOCK | |
|---|---|
| Distillation, volume % at °F. | |
| IBP | 403 |
| 10 | 516 |
| 30 | 605 |
| 50 | 730 |
| 70 | 1000 |
| IBP—975° F. | 65.4 wt % |
| 975° F.+ | 34.6 wt % |
| 975° F.+, toulene-insoluble (preasphaltene) | 10.4 wt % |
| 975° F.+, toulene-soluble (asphaltene) | 24.2 wt % |
| 975° F.+, benzene-insoluble (preasphaltene) | 8.5 wt % |
| 975° F.+, benzene-soluble (asphaltene) | 26.1 wt % |

The experiments are carried out at 810° and 850° F., 2800 psig total pressure, and 0.5 LHSV (volume of feed/hour/volume of catalyst), and excess hydrogen of 4000 SCF/Bbl. The catalyst is presulfided in the reactor prior to operation. At the end of a 3-day operation, a liquid product collected during the last 12-hour period is distilled to determine the wt % of 975° F.+ fraction. The 975° F.+ fraction is extracted by benzene or toluene in a Soxhlet extractor for its soluble and insoluble contents. Preasphaltene conversion and asphaltene conversion are calculated on the basis of these contents of the feedstock.

A standard shutdown procedure is used upon completion of an experiment, wherein the temperature is lowered to 650° F., and the catalyst is washed with anthracene oil for 1 hour. A representative sample of the used catalyst is extracted with benzene to remove any absorbed oil. After drying, the carbon content of the used catalyst is determined.

Comparative experiments are conducted on four catalysts containing Co-Mo or Ni-Mo on alumina with different pore characteristics. A description of these four catalysts together with their capabilities in conversion of 975° F.+ materials are summarized in Table 8. Preasphaltene conversions are above 95% among all the seven experiments conducted, with HDS 1442A having the lowest conversion. The asphaltene conversions are affected by reaction temperature, the metal composition and the pore characteristics of the catalyst and vary from 22 to 67%. CT 1008 has the same pore characteristics as the base catalyst HDS 1442A; CT 1008 contains Ni and Mo instead of Co and Mo. At 850° F. reaction temperature, the Ni-Mo catalyst shows higher asphaltene conversion than the Co-Mo catalyst. In addition, the capability of the Ni-Mo catalyst in asphaltene conversion increases with a drop in reaction temperature to 810° F., whereas the Co-Mo catalyst shows a decrease in asphaltene conversion. This reverse temperature effect shown by the Ni-Mo catalyst may be caused by the observed decrease of the carbon content of the used catalyst from 28.5 to 23.8 wt. % CT 2008 differs from CT 1008 in that it does not possess any significant amounts of macropores >1000 Å. Its superior ability in asphaltene conversion demonstrate that the presence of macropores >1000 Å is not needed for asphaltene conversion.

TABLE 8

CHARACTERISTICS OF SMALL PORE CATALYSTS AND THEIR CAPABILITIES IN CONVERSION 975° F. + MATERIALS

| Catalyst No. | HDS 1442A | CT 1008 | CT 2088 | CT 5008 |
|---|---|---|---|---|
| Mo $O_3$, % | 16.0 | 17.2 | 15.3 | 10.1 |
| Co O, % | 3.2 | — | — | — |
| Ni O, % | — | 3.5 | 3.2 | 2.4 |
| Size and Shape | | 1/16 inch extrudates | | |
| Surface Area, $M^2/g$ | 332 | 267 | 305 | 188 |
| Pore Size Distribution | | | | |
| PV cc/g <75Å | 0.37 | 0.35 | 0.48 | 0.11 |
| 75-150Å | 0.06 | 0.06 | 0 | 0.37 |
| 150-1,000Å | 0.17 | 0.09 | 0 | 0.02 |

TABLE 8-continued

CHARACTERISTICS OF SMALL PORE CATALYSTS AND THEIR CAPABILITIES IN CONVERSION 975° F. + MATERIALS

| Catalyst No. | HDS 1442A | CT 1008 | CT 2088 | CT 5008 |
|---|---|---|---|---|
| >1,000Å | 0.19 | 0.22 | 0.02 | 0.02 |
| Total | 0.69 | 0.72 | 0.50 | 0.52 |
| Preasphaltene Conversion | | | | |
| % at 850° F. | 95.2 | 99.2 | — | — |
| % at 810° F. | 95.6 | 99.7, 99.8 | 99.9 | 99.9 |
| Asphaltene Conversion | | | | |
| % at 850° F. | 35.6 | 53.6 | — | — |
| % at 810° F. | 22.2 | 55.9, 58.2 | 61.9 | 67 |
| Carbon in Used Catalyst | | | | |
| % at 850° F. | 30.1 | 28.5 | — | — |
| % at 810° F. | 25.3 | 23.3, 24.3 | 22.1 | 19 |

CT 5008 differs from CT 2008 in that the major portion of <75 Å micropores shift to 75 to 150 Å and CT 5008 has lower surface area and contains less Mo+Ni than CT 2008. CT 5008 has higher asphaltene conversion than CT 2008. This set of comparative experiments demonstrates that pore sizes >75 Å are needed for asphaltene conversion.

While I have shown and described a preferred form of embodiment of my invention, I am aware that modifications may be made thereto and I therefore desire a broad interpretation of my invention within the scope and spirit of the description herein and of the claims appended hereinafter.

What is claimed is:

1. A two-stage catalytic process for hydroconversion of coal to produce hydrocarbon liquid products and fuel gas, which comprises:

passing a preheated feed material containing solid coal particles and dissolved coal with hydrogen through a first stage catalytic reactor containing a large-pore catalyst and converting the coal to preasphaltene, coal asphaltene, distillate liquid and gas effluent material over the catalyst, said catalyst having macropores larger than 1000A occupying a major portion of the total pore volume;

passing the first-stage reactor effluent containing mainly preasphaltene, coal asphaltene and distillate through a second stage catalytic reactor containing a small-pore catalyst, and converting the preasphaltene and coal asphaltene to effluent material containing lower-boiling distillate liquid, said small pore catalyst having pores smaller than 1000A occupying a major portion of the catalyst total pore volume; and separating the second stage reactor effluent material into hydrocarbon gaseous and liquid products and a solids-containing insoluble material, and withdrawing a hydrocarbon liquid product from the process.

2. The process of claim 1 in which the first stage and the second stage reactors are each upflow ebullated bed catalytic reactors.

3. The process of claim 1 in which the first stage reactor is maintained under a total pressure of 2000–3000 psig and a temperature of 700°–900° F., and the second stage reactor is maintained under total pressure of 2000–3000 psig and a temperature of 650°–850° F., and with a coal feed rate of 5–150 lb. coal per hour per cubic foot of reactor volume.

4. The process of claim 1 in which the coal feed material is preheated to 500°–650° F. temperature which is lower than the first stage reactor outlet temperature by as much as 400° F.

5. The process of claim 1 in which a portion of the solids-containing material is recycled to the preheating step.

6. The process of claim 1 in which a portion of the liquid product is recycled to the feedstream as a hydrocarbon solvent material.

7. The process of claim 1, wherein the first stage large-pore catalyst contains macropores having a pore diameter range of 2000–20,000A occupying a major portion of the catalyst total pore volume.

8. The process of claim 1, wherein for bituminous coal feed the first stage large-pore catalyst contains macropores having a pore diameter range of 2000–9000A occupying a major portion of the catalyst total pore volume.

9. The process of claim 1, wherein the catalyst pore diameter size of the small-pore catalyst used in said second stage reactor is 1/5 to 1/20 of the pore diameter size of the large-pore catalyst used in said first stage reactor.

10. The process of claim 1, wherein for coal feed the second stage small-pore catalyst contains pores having diameters of 75–1000A occupying a major portion of the catalyst total pore volume.

11. The process of claim 1, wherein the catalyst used in said first stage and second stage reactors contain at least one active metal selected from the group of Co, Mo, Ni, Sn and W and mixtures thereof on a support containing an oxide of aluminum, calcium, magnesium, silicon, titanium, and compounds thereof.

12. A two-stage catalytic process for hydrogenation and hydroconversion of coal to produce hydrocarbon liquid products and fuel gas, which process comprises:

(a) providing a feed stream of coal mixed with hydrocarbon liquid solvent to form a coal/solvent slurry and preheating the slurry feed material to 500°–650° F.;

(b) passing the preheated feed material containing solid coal particles and dissolved coal together with hydrogen through a first stage catalytic reactor maintained at 700°–900° F. temperature, 2000–3000 psig total pressure, and containing a bed of large-pore catalyst, the coal feed rate being 5–150 pounds/hour per cubic foot reactor volume, and hydroconverting the coal to preasphaltene, coal asphaltene, distillate liquid and gas effluent material over the catalyst, said catalyst having a total pore volume of 0.2–1.0 cc/gm with median pore diameter being about 1000–20,000A occupying a major portion of the catalyst total pore volume;

(c) passing the first-stage effluent material containing mainly preasphaltene, coal asphaltene and distillate liquid through a second stage catalytic reactor maintained at 650°–850° F. temperature, 2000–3000 psig total pressure, and containing a bed of small-pore catalyst, and converting the preasphaltene and coal asphaltene to effluent material containing lower-boiling distillate liquid, said small-pore catalyst having pore diameters of 75–1000A occupying a major portion of the catalyst total pore volume; and (d) separating the second stage reactor effluent material into hydrocarbon gaseous and liquid products and a solids-containing insoluble material, recycling a portion of the hydrocarbon liquid to the feedstream, and withdrawing a hydrocarbon liquid product from the process.

13. A two-stage catalytic process for hydroconversion of petroleum asphaltene to produce hydrocarbon liquid products and fuel gas, which comprises:

passing a preheated feed material containing petroleum asphaltene with hydrogen through a first stage catalytic reactor containing a large-pore catalyst and converting the petroleum asphaltene to effluent material containing oil, distillate liquid and gas, said catalyst having macropores with diameters larger than 1000A occupying a major portion of the total pore volume and avoiding micropores having diameters smaller than 50A;

passing the first-stage reactor effluent material containing mainly oil and distillate liquid through a second stage catalytic reactor containing a small-pore catalyst and further converting the oil and distillate liquid to lower-boiling distillate product, said small-pore catalyst having pores smaller than 1000A occupying a major portion of the catalyst total pore volume; and separating effluent from the second stage reactor into hydrocarbon gaseous and liquid products and withdrawing a hydrocarbon liquid product from the process.

14. The process of claim 13, wherein for the petroleum asphaltene feed the first stage large-pore catalyst contains macropores having pore diameters in the range of 1000–3000A occupying a major portion of the catalyst total pore volume.

15. The process of claim 13 in which the first stage and the second stage reactors are each upflow ebullated bed catalytic reactors.

16. The process of claim 13 in which the first stage reactor is maintained at 700°–900° F. temperature and under a total pressure of 2000–3000 psig, and the second stage reactor is maintained at 650°–850° F. temperature and under total pressure of 2000–3000 psig, and with a petroleum asphaltene feed rate of 0.1–2 liquid hourly space velocity (LHSV).

17. The process of claim 13 in which a portion of the hydrocarbon liquid product is recycled to the preheating step.

18. The process of claim 13, in which a portion of the liquid product is recycled to the feedstream to achieve higher hydroconversion to lower-boiling hydrocarbon liquid products.

19. The process of claim 13, wherein the catalyst pore diameter size of the small-pore catalyst used in said second stage reactor is 1/5 to 1/20 of the pore diameter size of the large-pore catalyst used in said first stage reactor.

20. The process of claim 13, wherein for the petroleum asphaltene feed the second stage small-pore catalyst contains pores having diameters of 75–1000A occupying a major portion of the catalyst total pore volume.

21. The process of claim 13, wherein the catalyst used in said first stage and second stage reactors contain at least one active metal selected from the group of Co, Mo, Ni, Sn and W and mixtures thereof on a support material containing an oxide of aluminum, calcium, magnesium, silicon, titanium, and compounds thereof.

22. A two-stage catalytic process for hydroconversion of petroleum asphaltene feed to produce hydrocarbon liquid products and fuel gas, which process comprises:

(a) providing a feed stream of petroleum asphaltene and preheating the feed material;

(b) passing the preheated feed material containing the petroleum asphaltene together with hydrogen through a first stage catalytic reactor maintained at 700°–900° F. temperature, 2000–3000 psig total pressure, and containing a bed of large-pore catalyst, the petroleum asphaltene feed rate being 0.1–2.0 liquid hourly space velocity (LHSV), and hydroconverting the petroleum asphaltene to an effluent material containing oil, distillate liquid and gas, said catalyst having a total pore volume of 0.2–1.0 cc/gm with median pore diameter being about 1000–3000A occupying a major portion of the catalyst total pore volume and avoiding micropores having diameters smaller than 50A;

(c) passing the first stage reactor effluent material containing mainly oil and distillate liquid through a second stage catalytic reactor maintained at 650°–850° F. temperature, 2000–3000 psig total pressure, and containing a bed of small-pore catalyst and converting the oil and distillate liquid to lower-boiling distillate product, said small-pore catalyst having pore diameters of 75–1000A occupying a major portion of the catalyst total pore volume; and (d) separating effluent material from the second stage reactor into hydrocarbon gaseous and liquid products, recycling a portion of the hydrocarbon liquid to the feedstream, and withdrawing a hydrocarbon liquid product from the process.

* * * * *